US006718710B2

(12) United States Patent
Platt

(10) Patent No.: US 6,718,710 B2
(45) Date of Patent: Apr. 13, 2004

(54) POST MOUNT

(76) Inventor: Robert E. Platt, 8701 Highland Ave., Mineral Ridge, OH (US) 44440

( * ) Notice: Subject to any disclaimer, the term of this patent is extended or adjusted under 35 U.S.C. 154(b) by 0 days.

(21) Appl. No.: 10/162,468

(22) Filed: Jun. 3, 2002

(65) Prior Publication Data

US 2003/0221385 A1 Dec. 4, 2003

(51) Int. Cl.[7] ..... E02D 27/00
(52) U.S. Cl. ..... 52/296
(58) Field of Search ..... 52/170, 296, 720.2, 52/736.1, 736.3, 736.4, 737.5, 738.1

(56) References Cited

U.S. PATENT DOCUMENTS

| | | | | | |
|---|---|---|---|---|---|
| 3,241,279 | A | | 3/1966 | Bailey | |
| 3,256,659 | A | | 6/1966 | Dudoff | |
| 3,349,531 | A | | 10/1967 | Watson | |
| 4,104,000 | A | * | 8/1978 | Fleischmann | 403/7 |
| 4,603,526 | A | | 8/1986 | Bollmann | |
| 4,662,139 | A | | 5/1987 | Bollmann | |
| 4,793,111 | A | * | 12/1988 | Shewchuk | 52/298 |
| 4,809,955 | A | * | 3/1989 | Veilleux | 256/65.02 |
| 5,499,885 | A | * | 3/1996 | Chapman | 403/380 |
| 5,746,031 | A | * | 5/1998 | Burns | 52/170 |
| 6,098,353 | A | * | 8/2000 | Stanfield | 52/170 |
| 6,141,928 | A | * | 11/2000 | Platt | 52/296 |
| 6,213,452 | B1 | * | 4/2001 | Pettit et al. | 256/59 |
| 6,290,212 | B1 | * | 9/2001 | Bartel | 256/65.14 |
| 6,508,457 | B1 | * | 1/2003 | Knudson et al. | 256/65.01 |

* cited by examiner

*Primary Examiner*—Leslie A. Braun
*Assistant Examiner*—Kofi Schulterbrandt
(74) *Attorney, Agent, or Firm*—Sand & Sebolt

(57) ABSTRACT

A post mount for affixing a construction member having a cavity to a floor includes a support block, an adjustment plate, a plurality of adjustment bolts threadably mounted to the adjustment plate, a bearing plate, a plurality of optional compression pins, a clamping plate, a bolt extending therethrough, and a nut connected to the bolt. The support block is fixedly attached to the floor and is slidingly received in the cavity. The post mount securely affixes the post to the floor and permits the post to be oriented plumb with the vertical direction and provides support to allow the post to withstand moderate shock loading to the lower end thereof.

21 Claims, 10 Drawing Sheets

| |
|---|
| FIG-2C |
| FIG-2B |
| FIG-2A |

POST MOUNT

BACKGROUND OF THE INVENTION

1. Technical Field

The invention relates generally to a support for a fence post and, more particularly, to a support that is easily manufactured and assembled, resists shock loading to the post, provides a rigid upright support for a railing, and that permits the post to be aligned plumb with the vertical direction. Specifically, the invention relates to a support that is mounted to a floor and is slidingly received in a cavity formed in a post, the support being adjustable to orient the post plumb with the vertical direction and permitting the post to withstand shock loading at the lower end thereof.

2. Background Information

Fences and railings are used in numerous building applications for diverse purposes, the most typical being to provide a barrier adjacent the edge of an elevated floor structure such as a porch, a balcony, or a recreational deck. Such fences often contain a plurality of posts affixed to and extending upwardly from the floor with stringers and balusters connecting the posts with one another to form a continuous structure around the exposed circumference of the floor. The attachment of each of the posts to the floor and the consecutive connection of the posts with one another provide a relatively strong barrier that protects a person from inadvertently falling off the edge of the floor.

Numerous materials are used for making such fences—including wood, metal, and polyvinyl chloride (PVC), among other materials. Among the most popular fences have been those constructed of hollow sections of PVC due to advantages in cost, workability, weight, versatility, and longevity, as well as other relevant factors. The use of such PVC fences has not, however, been without limitation.

Hollow PVC posts have heretofore been difficult to securely attach to the floor inasmuch as the PVC itself typically does not provide a solid anchor for threaded fasteners such as screws and bolts that are typically used to attach a post to the floor. It is also known that PVC posts provide insufficient resistance to impact loading at the lower end where the post is connected to the floor and where the post is subject to accidental bumping and kicking by persons standing on the floor. Moreover, fences and railings are most structurally sound and most aesthetically pleasing when the posts are oriented plumb with the vertical direction, and hollow PVC posts have proven to be difficult to fixedly attach to a floor in a direction plumb with the vertical inasmuch as the walls of the post are relatively thin and not suited to accept threaded fasteners therein. A need thus exists for a post mount that securely attaches a hollow PVC post to a floor, permits the post to be oriented plumb with the vertical direction, and provides sufficient strength to allow the post to withstand moderate shock loading at its lower end.

One solution is disclosed in U.S. Pat. No. 6,141,928. The invention is a post mount for affixing a construction member having a cavity to a floor where the post mount includes a support block, an adjustment plate, a plurality of adjustment bolts threadably mounted to the adjustment plate, a bearing plate, a plurality of optional compression pins, a clamping plate, a bolt extending therethrough, and a nut connected to the bolt. The support block is fixedly attached to the floor and is slidingly received in the cavity. The post mount securely affixes the post to the floor and permits the post to be oriented plumb with the vertical direction and provides support to allow the post to withstand moderate shock loading to the lower end thereof.

It has been found that this solution is quite useful in many applications; however the support block is a complicated design requiring significant extrusion and/or machining. It further requires a rather large bolt that holds the entire assembly together that must be of a design that is strong enough to firmly and securely hold the assembly together and prohibit rocking, twisting, etc.

BRIEF SUMMARY OF THE INVENTION

In view of the foregoing, advantages are obtained by the improved post mount of the present invention, the general nature of which may be stated as including a post mount that securely mounts a hollow construction member having a cavity, such as a post, to a floor, where the post mount being slidably received in the cavity. Other advantages to the present invention exist including any one or more of the following: providing a post mount that adjustably orients a construction member plumb with the vertical direction, providing a post mount that is easy to manufacture and enhances the structural integrity of a hollow construction member mounted to a floor and that permits the post to withstand moderate shock loading at the lower end thereof, providing a post mount that can be used to attach a hollow construction member to a variety of different types of floors, and providing a post mount that securely attaches a construction member to a floor and prevents movement of the post relative to the floor.

BRIEF DESCRIPTION OF THE SEVERAL VIEWS OF THE DRAWINGS

The preferred embodiment of the invention, illustrative of the best mode in which applicant has contemplated applying the principles of invention, is set forth in the following description and is shown in the drawings and is particularly and distinctly pointed out and set forth in the appended claims.

FIG. 2A is an exploded view of a portion of the first embodiment;

FIG. 2B is an exploded view of a portion of the first embodiment;

FIG. 2C is an exploded view of the post used in conjunction with the first embodiment;

Similar numerals refer to similar parts throughout the specification.

DETAILED DESCRIPTION OF THE INVENTION

Figures 1, 2:
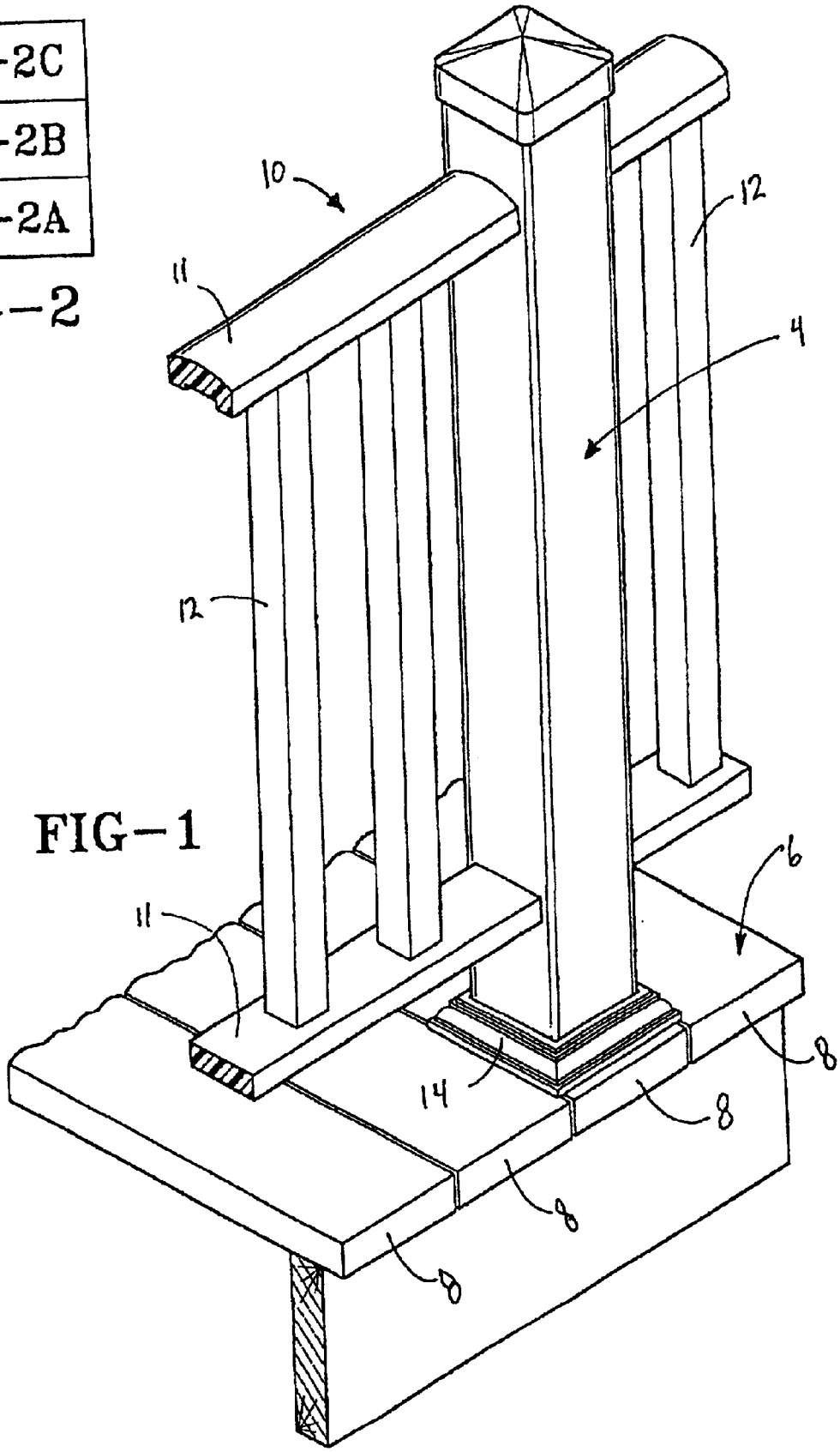
FIG. 1 is a perspective view of a fence that incorporates the post mount of the present invention.
FIG. 2 comprising
Figure 2A:
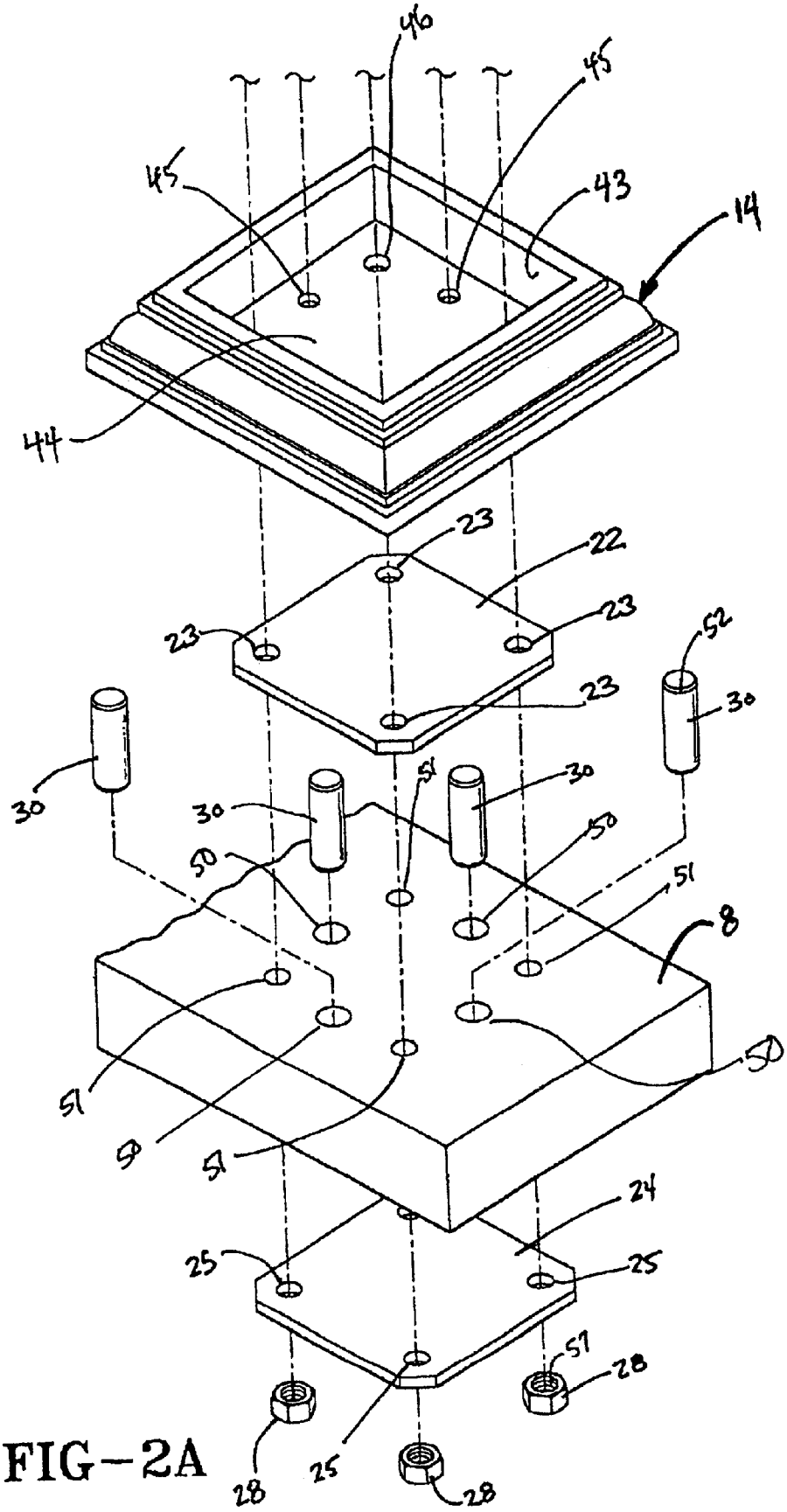
FIGS. 2A, 2B, and 2C, is an exploded view of a first embodiment of the post mount of the present invention.

A typical fence or railing type system 10 is shown in FIG. 1 for use on a porch, balcony, recreational deck or the like where the railing system includes posts 4 substantially vertically extending from a floor 6 with a railing connected between adjacent posts. One embodiment of a post mount 2 of the present invention is used to support each post 4 where the post mount 2 is best shown exploded apart in FIGS. 2A, 2B and 2C, in section in FIG. 3, and in longitudinal section in FIG. 4.

In more detail and breadth, post mount 2 is used to affix a construction member such as post 4 to a surface such as floor 6. In the event that floor 6 is constructed of wood planking, it is preferred that post mount 2 be centered over a single plank 8 instead of spanning multiple planks. Nevertheless, post mount 2 may be installed such that it spans several planks without departing from the spirit of the present invention.

Post 4 is a construction member that is a structural component of a fence 10 that is attached to floor 6. As is known in the art, fence 10 includes one or more posts 4 attached to floor 6 with a pair of stringers 11 attached between posts 4, one stringer 11 at an upper end of post 4 and the other stringer 11 at the lower end thereof. One or more balusters 12 often extend between stringers 11 whereby the combination of stringers and balusters defines a railing. The specific configuration of stringers 11 and balusters 12 depends upon the particular needs of the application and the desired aesthetic characteristics to be achieved.

Post 4 is formed with a cavity 13 at least at the lower end thereof. In the preferred embodiments, cavity 13 extends longitudinally through the length of post 4 to render post 4 a hollow member, but it is understood that post 4 could be solid except for cavity 13 at a lower end thereof without departing from the spirit of the present invention. Post 4 additionally includes a base molding 14 that extends around the circumference of post 4 at or approximate its point of connection with floor 6. Base molding 14 provides an aesthetic transition between post 4 and floor 6 and additionally can cover portions of post mount 2 that may protrude from underneath or from the lower end of post 4. Base molding 14 can, however, be omitted without departing from the spirit of the present invention.

Figure 2B:
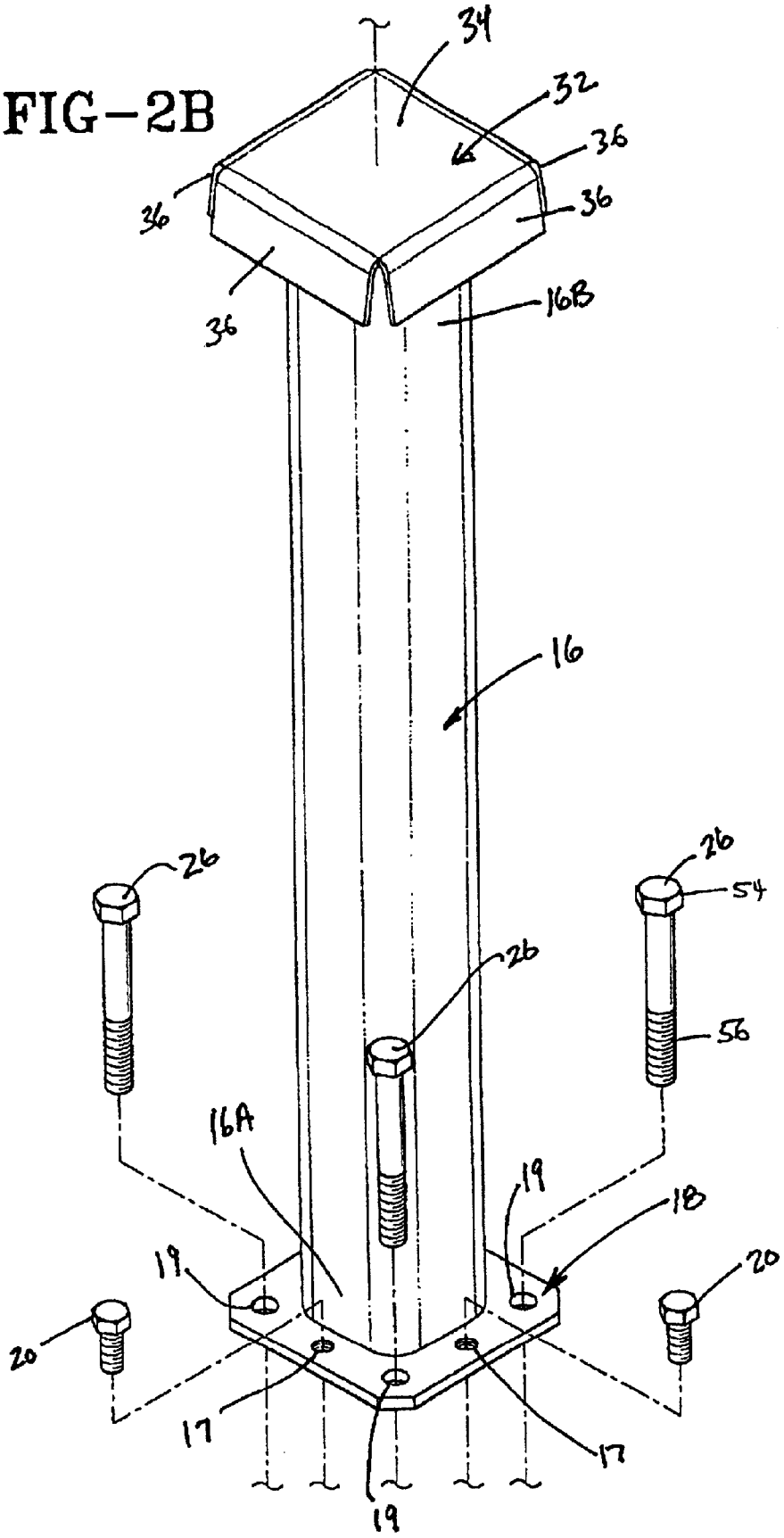
Figure 2C:
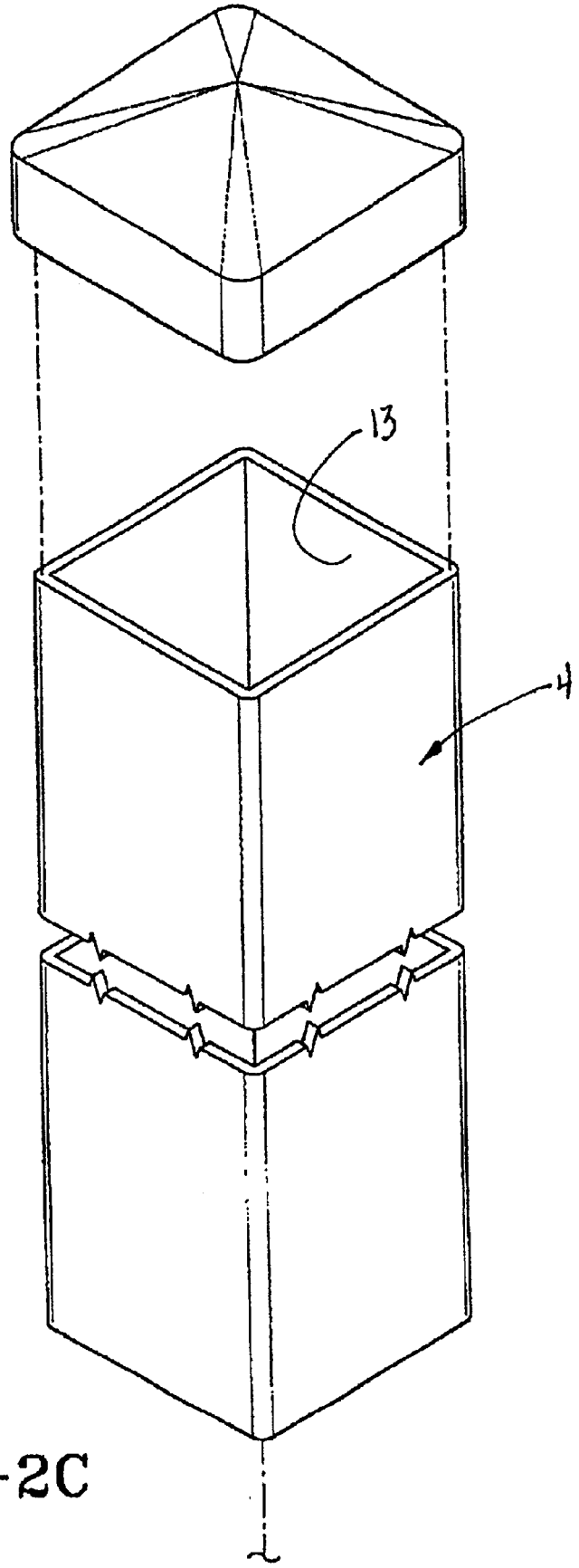
Figure 3:
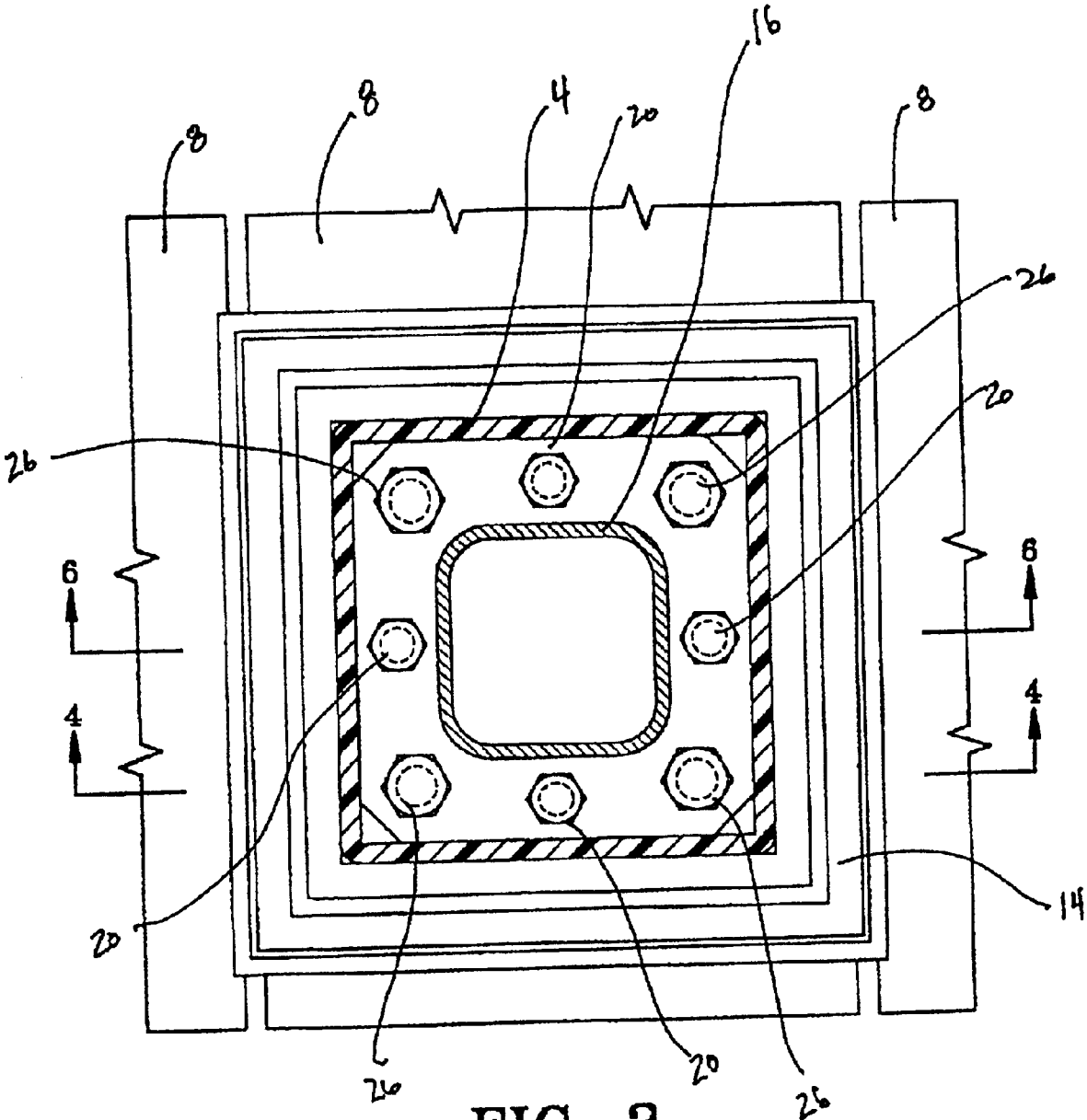
FIG. 3 is a sectional view of the first embodiment as shown along line 3—3 of FIG. 1.
Figure 4:
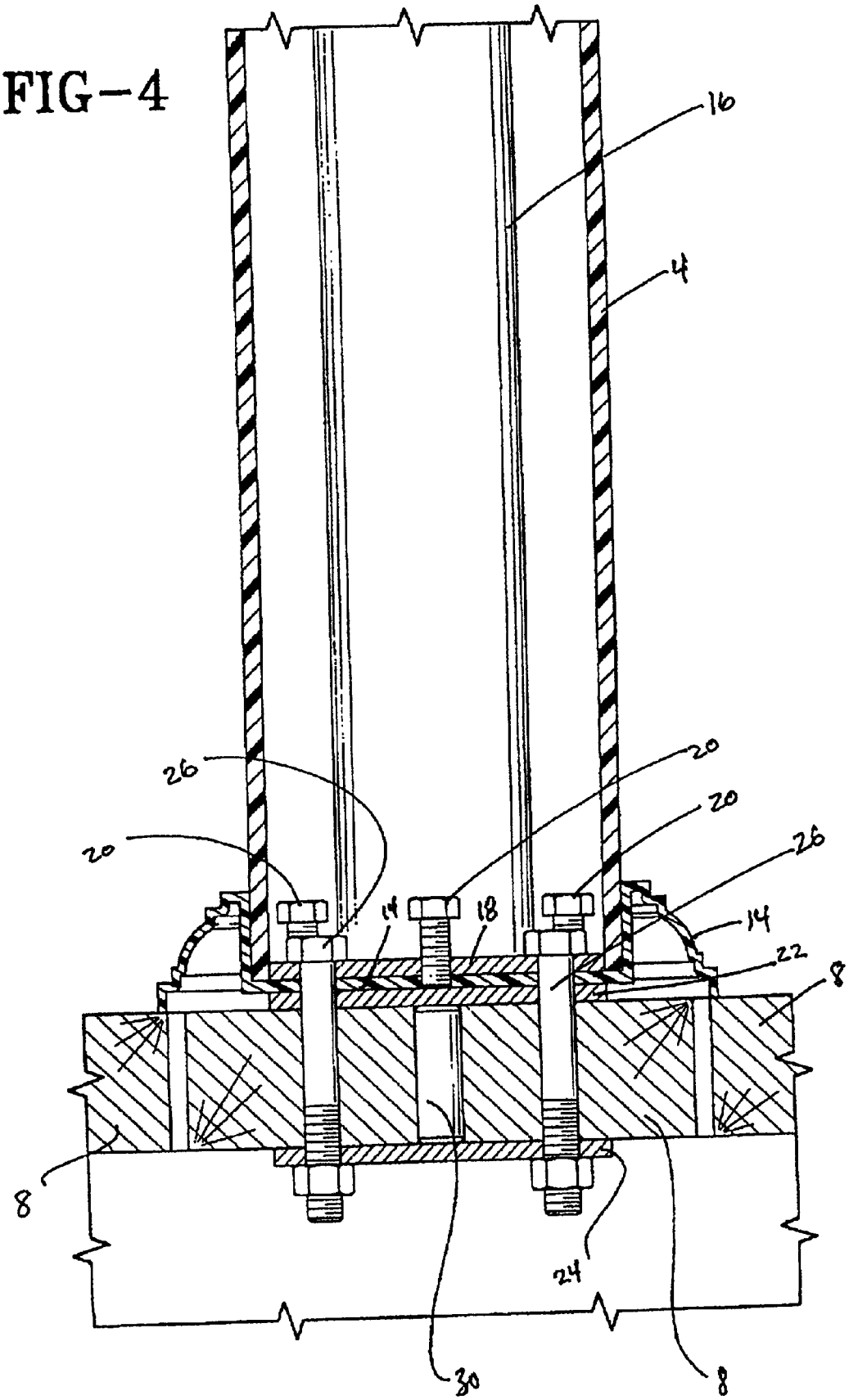
FIG. 4 is a longitudinal sectional view of the first embodiment as shown in FIG. 1 taken along line 4—4 of FIG. 3.
Figure 8:
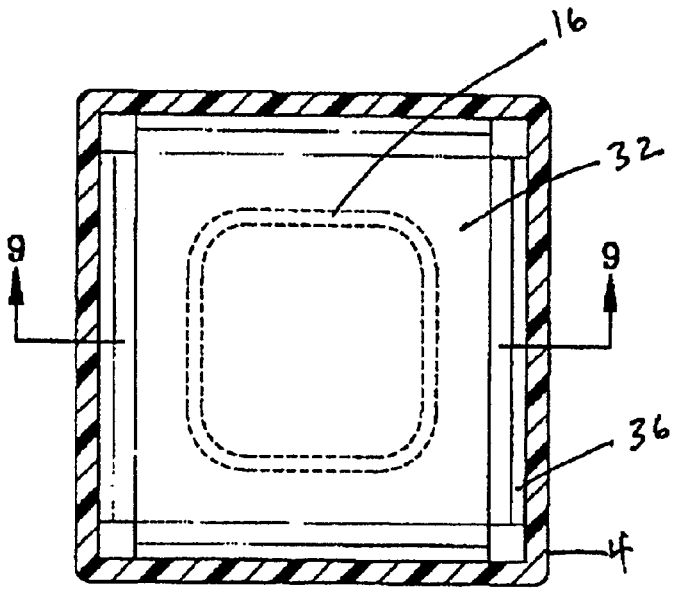
FIG. 8 is a sectional view of the first embodiment as shown along line 8—8 of FIG. 1.

Post mount 2 includes a support block or elongated body 16 with an adjustment plate 18 at one end thereof with a plurality of adjustment holes 17 and a plurality of securing holes 19 therein, a plurality of adjustment bolts 20, a bearing plate 22 with a plurality of securing holes 23 therein, a clamping plate 24 with a plurality of securing holes 25 therein, a plurality of securing bolts 26, a plurality of nuts 28, and a plurality of compression pins 30. Support block 16 is an elongated member situated in an upright manner as best shown in FIG. 2B. Support block 16 further is preferably of a hollow construction as best shown in FIGS. 3 and 8, and is shown as being of a square cross section although it may be of any of a number of cross sectional shapes including circular, oval, rectangular, pentagonal, hexagonal or of any other known geometrical shape.

The specific configuration of support block 16 provides strength and permits support block 16 to resist bending and twisting forces. Support block 16 may be readily manufactured by extrusion processes known and understood in the art, with support block 16 being manufactured out of a readily extrudable material such as aluminum, PVC, vinyl, or other such appropriate material. Other methods may be used to manufacture support block 16 without departing from the spirit of the present invention. While in the preferred embodiments support block 16 is an elongated extruded body having the specific configuration described above, it is understood that support block 16 may be manufactured out of an elongated block of an appropriate material such as wood or PVC or other such material formed without departing from the spirit of the present invention.

In accordance with one of the features of the present invention, the support block 16 is typically smaller in cross section than the hollow post 4 that it is positionable within so as to allow for easy insertion of the support block within the post. In more detail, the support block 16 has a first or bottom end 16A and a second or top end 16B. The first end 16A is securely affixed to the adjustment plate 18 by any means known in the art such as welding.

Figure 9:
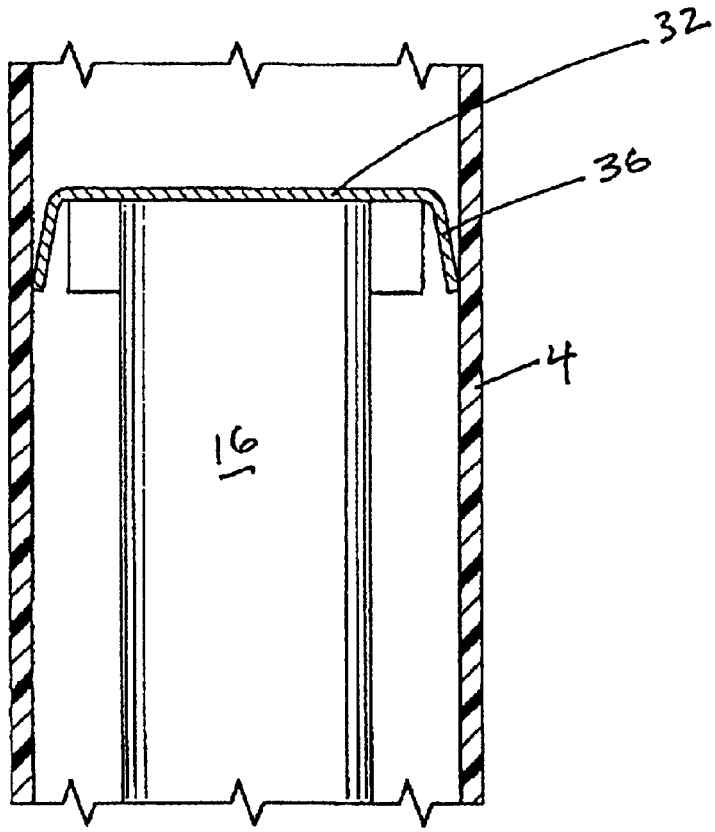
FIG. 9 is a longitudinal sectional view of the first embodiment as shown in FIG. 1 taken along line 9—9 of FIG. 8.

In the preferred embodiment of the present invention and in accordance with one of the features of the invention, a head 32 is affixed to the second end 16B as best shown in the FIGS. 2B and 9. Head 32 is preferably any feature that extends radially or similarly outward from the support block 16 at or near the second end 16B so as to function as a guide when the post 4 is slipped over the support block 16 and a stop that snugly prohibits the post 4 from rocking on the support block 16.

In one embodiment as shown in FIGS. 2B and 9, the head 32 includes an end plate 34 with a plurality of tabs 36 extending from the periphery of the end plate 34. The tabs 36 arcuately transition out of the end plate 34 such that the tabs as a group define a perimeter that frictionally interacting with an inner surface of the post 4 when the head is positioned within the cavity 13; the tabs also being defined so as to deflect inward and thus flex during loading as the head 36 is inserted into the cavity 13 thereby allowing for easier insertion while also providing for an outward pushing tight fit once the head 36 is properly seated in the cavity 13.

Adjustment plate 18 is a plate having a perimeter that similarly corresponds with the inner surface of the post 4 when the head is positioned within the cavity 13. Adjustment plate 18 has the plurality of threaded adjustment holes 17 located at approximately the midpoint of each side. Threaded holes 17 cooperate threadably with adjustment bolts 20 to permit adjustment plate 18 to be selectively adjusted with respect to floor 6 by the selective rotation of adjustment bolts 20. Inasmuch as support bock 16 is compressively held against adjustment plate 18, as will be set forth more fully below, adjustment plate 18 is manufactured of a material appropriate to withstand the stresses typically experienced with such compression, such as steel or other such appropriate material, and is of a corresponding thickness appropriate to withstand such stresses. Adjustment plate 18 is additionally formed with the plurality of securing holes 19 disposed therein each proximate a corner of the adjustment plate 18 and sized to accommodate one bolt 26 therethrough with substantially no resistance.

Base molding 14 is a trim member formed with an opening 43 sized and shaped to slidably receive a portion of post 4 therein. Opening 43 terminates at a retention plate 44 at a lower end thereof. Retention plate 44 has a plurality of holes 45 that align with threaded holes 17 of adjustment plate 18. Holes 45 are sized to accommodate adjustment bolts 20 therethrough with substantially no contact or substantially no resistance. Retention plate 44 is additionally formed with a plurality of bolt holes 46 that align with holes 19 respectively and are sized to accommodate bolts 26 therethrough with substantially no resistance. Base molding 14 is, in the preferred embodiments, manufactured of a material similar to or compatible with the material used to manufacture post 4, although other materials may be used without departing from the spirit of the present invention.

Bearing plate 22 is a plate that preferably has external dimensions of the same size or at least nominally greater than those of adjustment plate 18 but less than those of base molding 14 to permit base molding 14 to cover bearing plate 22. Inasmuch as bearing plate 22 is compressed between adjustment bolts 20 and plank 8, as will be set forth more fully below, bearing plate 22 is manufactured of a material appropriate to withstand the bearing force imparted by adjustment bolts 20 such as steel, although other materials may be used without departing from the spirit of the present invention. Bearing plate 22 is formed with a plurality of bolt holes 23 that each align with respective holes 46 and 19 and are sized to accommodate a respective bolt 26 therethrough with substantially no resistance.

Plank 8 is drilled or otherwise formed to include a plurality of pin holes 50 sized to accommodate compression pins 30 therein. It is preferred that pin holes 50 be configured to provide a nominal interference fit with compression pins 30 to facilitate assembly of post mount 2 by permitting compression pins 30 to be easily inserted into pin holes 50 while preventing compression pins 30 from falling out of pin holes 50 at the underside thereof. Plank 8 is additionally drilled or otherwise formed to have a plurality of bolt holes 51 that each align with respective holes 23, 46 and 19 and are sized to accommodate bolt 26 therein with substantially no resistance.

Compression pins 30 are elongated cylindrical members that are suited to withstand the compression between bearing plate 22 and clamping plate 24, as will be set forth more fully below. Compression pins 30 are thus manufactured of a material such as steel, although other appropriate materials may be used without departing from the spirit of the present invention. The ends of compression pins 30 may have a bevel 52 to facilitate their insertion into pin holes 50, although compression pins 30 may have non-beveled ends without departing from the spirit of the present invention.

Clamping plate 24 is a substantially rectangular plate corresponding roughly to the size of adjustment plate 18 and formed with a bolt hole 53 that aligns with hole 51 and accommodates bolt 26. Clamping plate 24 is manufactured of a material suited to withstand the forces that may be imparted by bolt 26 such as steel or other appropriate material and is of a correspondingly appropriate thickness.

Bolts 20 and 26 are elongated bolts of the type known and understood in the relevant art and includes a head 54 at one end and a plurality of external threads 56 formed on the other end thereof. Each nut 28 includes a plurality of internal threads 57 that cooperate threadably with external threads 56. In the preferred embodiment, each nut 28 is a separate component of post mount 2, but in other embodiments (not shown) nut 28 may be fixedly attached to clamping plate 24 without departing from the spirit of the present invention. Each bolt 26 is configured to be slidingly received within respective holes 19, 46, 23, 51 and 25 and is of sufficient length to extend through adjustment plate 18, retention plate 44, bearing plate 22, plank 8 of floor 6, and clamping plate 24, and still extend sufficiently beyond clamping plate 24 to permit nut 28 to be threaded thereon and to permit adjustment plate 18 to be adjusted by adjustment bolts 20 as will be set forth more fully below. Bolt 26 and nut 28 are preferably manufactured of materials suited to withstand the tension that will be experienced by bolt 26 in the present application, as will be set forth more fully below, such as steel or other appropriate materials.

In use, post 4 is connected to floor 6 by installing post mount 2 onto plank 8 and sliding post 4 onto post mount 2 such that support block 16 with head 32 is slidably received in cavity 13. Post mount 2 is installed on floor 6 by first installing compression pins 30 in pin holes 50. Adjustment bolts 20 are then threaded into threaded holes 17 of adjustment plate 18 until the threaded tips of adjustment bolts 20 protrude slightly from the underside of adjustment plate 18. The threaded tips of adjustment bolts 20 should initially protrude from adjustment plate 18 at least slightly more than the thickness of retention plate 44.

Each bolt 26 is then inserted into respective hole 19, with the threaded end of bolt 26 then being passed through hole 19 of adjustment plate 18, bolt hole 46 of base molding 14, bolt hole 23 of bearing plate 22, bolt hole 51 of floor 6, and bolt hole 25 of clamping plate 24 such that the aforementioned components are properly stacked once all of the bolts 26 are inserted. Each nut 28 is threaded slightly onto threads 56 of bolt 26 to prevent the aforementioned parts from separating. A level (not shown) is then applied to at least two vertical surfaces of support block 16 to determine whether or not support block 16 is oriented plumb with the vertical direction. Inasmuch as support block 16 is disposed on the upper surface of adjustment plate 18, adjustment of adjustment plate 18 with respect to floor 6 results in a corresponding angular movement of support block 16. In accordance with the features of the present invention, adjustment bolts 20 are each incrementally adjusted until support block 16 is oriented plumb with the vertical direction. Each bolt 20 threadably engages adjustment plate 18 and abuts bearing plate 22 which does not move relative to plank 8. Thus, rotation of bolts 20 causes adjustment plate 18 to move with respect to bearing plate 22. It is understood that support block 16 may be oriented in a non-plumb orientation as needed for a particular application without departing from the spirit of the present invention.

Each nut 28 is then tightened on its respective bolt 26 until an appropriate level of tension is achieved in each bolt 26. In such condition, support block 16, adjustment plate 18, bearing plate 22, compression pins 30, and clamping plate 24 are compressed between the heads 54 and nuts 28. Support block 16 is compressed against adjustment plate 18, and adjustment bolts 20 carried by adjustment plate 18 are compressed against bearing plate 22. Bearing plate 22 is compressed against both compression pins 30 and plank 8. In this regard, compression pins 30 and plank 8 are compressed between bearing plate 22 and clamping plate 24.

After support block 16 has been oriented to the plumb or non-plumb orientation desired and nuts 28 have been tightened onto bolt 26, the post 4 is prevented from moving due to the rigidity of the support block 16 and the tabs 36 that extend outward therefrom so as to snuggly engage the inner surface of the post 4. In the preferred embodiment, the tabs taper outward and angularly as shown in FIG. 2B so as to allow for easy sliding of the post 4 over the tabs 36 while providing a snug fit due to a slight spring action and this is best shown in FIGS. 8 and 9.

Stringers 11 and balusters 12, or other such structures as are desired are then installed to form fence 10.

As is understood in the relevant art, plank 8, if manufactured of wood, may be incapable of sustaining significant levels of compressive force for extended periods of time. In accordance with the features of the present invention, the positioning of compression pins 30 in substantial axial alignment with adjustment bolts 20 causes a substantial portion of the compressive force of bolt 26 to be carried by compression pins 30. Thus, support block 16 can be tightly compressed against floor 6 without plank 8 being overcompressed thereby and potentially damaged. Further in accordance with the features of the present invention, adjustment bolts 20 permit support block 16 to be aligned plumb with the vertical direction and to maintain the plumb orientation thereof despite the compressive force imparted between bolts 26 and nut 28.

Figure 7:
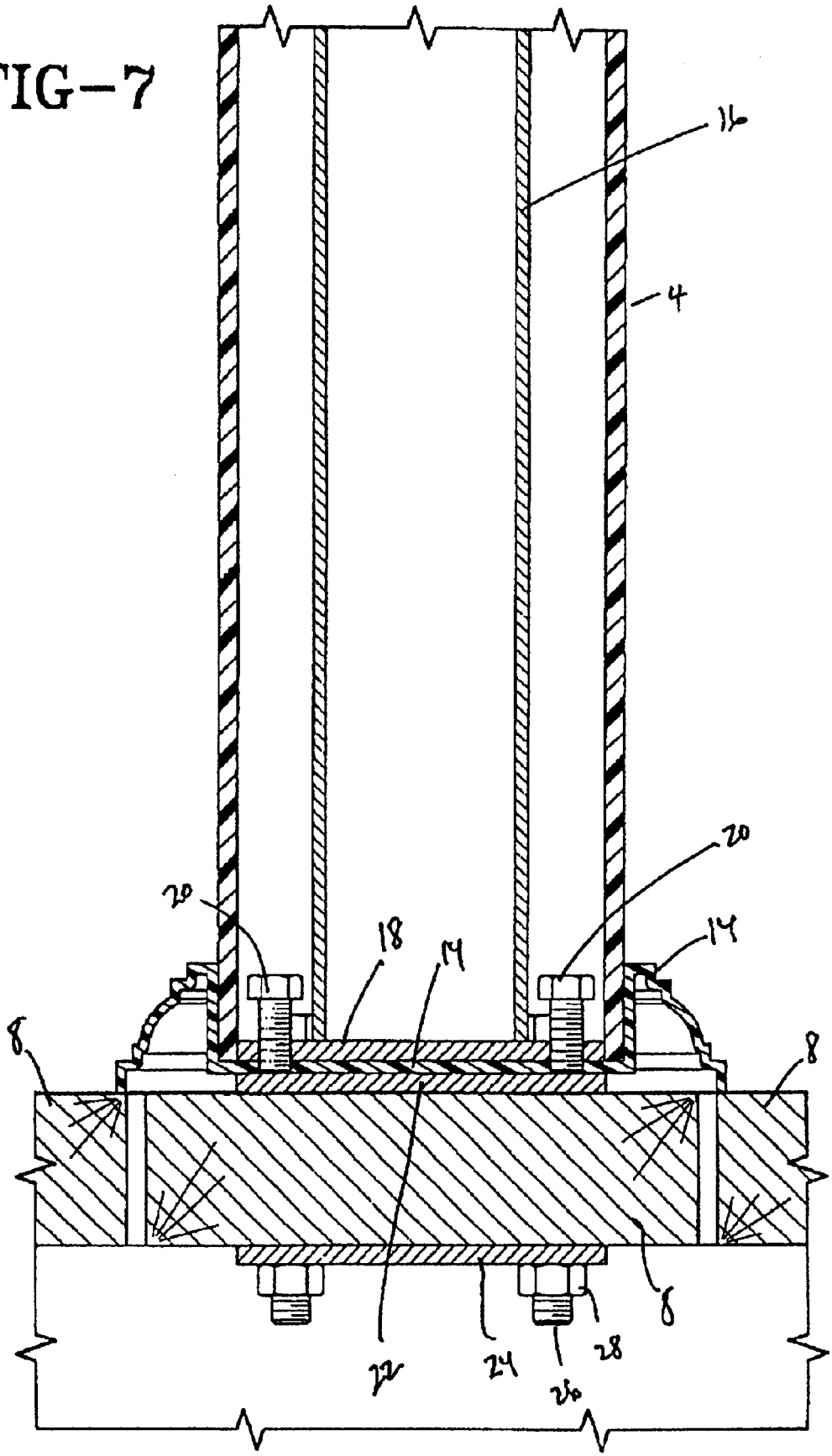
FIG. 7 is a view similar to FIG. 6 depicting an optional configuration of the first embodiment where compression pins are not used.

An optional configuration of the first embodiment of the present invention is depicted in FIG. 7 wherein post mount 2 does not include compression pins 30. In this regard, adjustment bolts 20 compress against bearing plate which, in turn, compresses directly against plank 8. The optional configuration shown in FIG. 7 is especially useful in situations where a lesser degree of compression is required to retain support block 16 against floor 6 or where plank 8 is manufactured of materials having qualities enabling it to withstand the compression provided between bolt 26 and nut 28.

Figure 5:
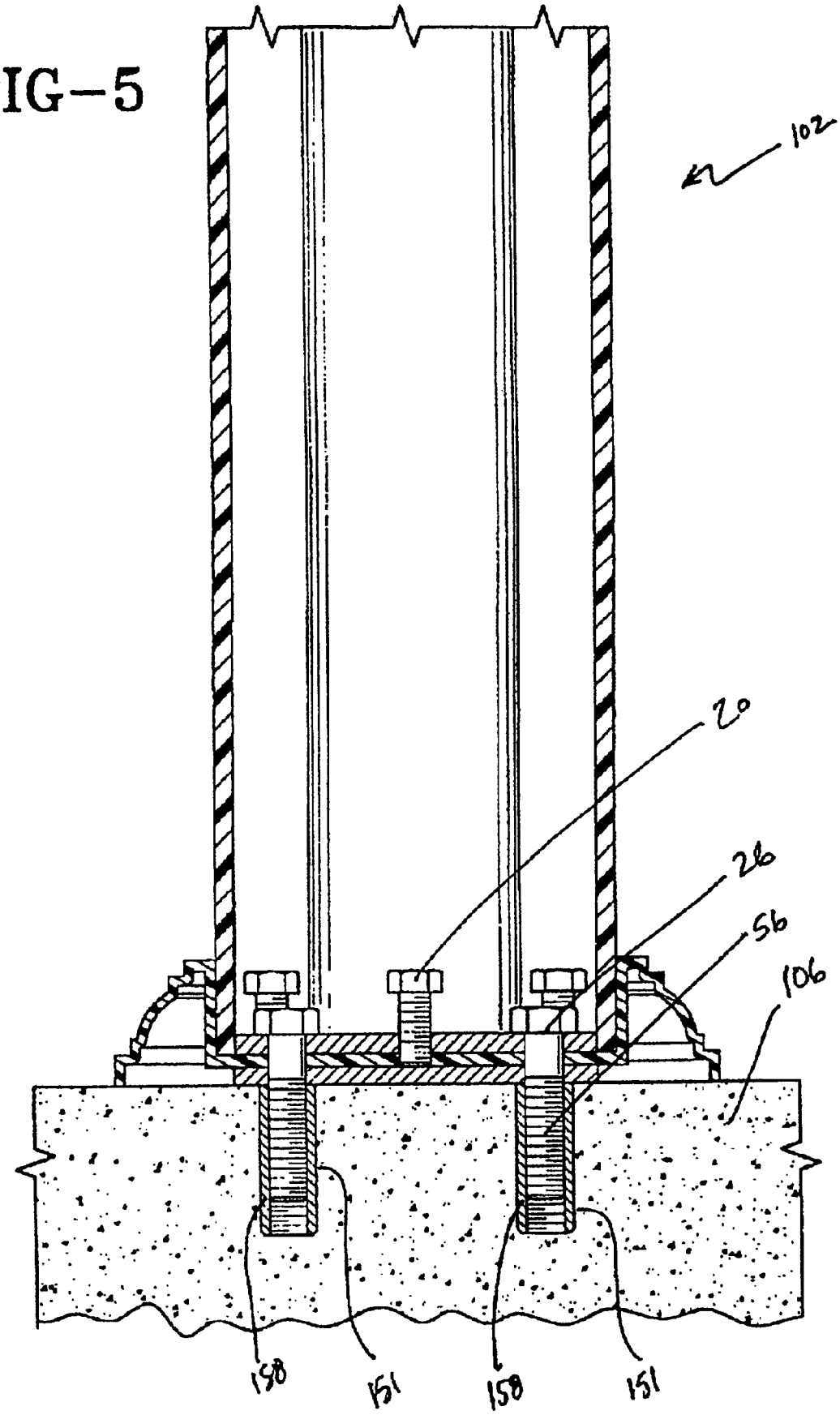
FIG. 5 is a longitudinal sectional view of a second embodiment of the post mount of the present invention.
Figure 6:
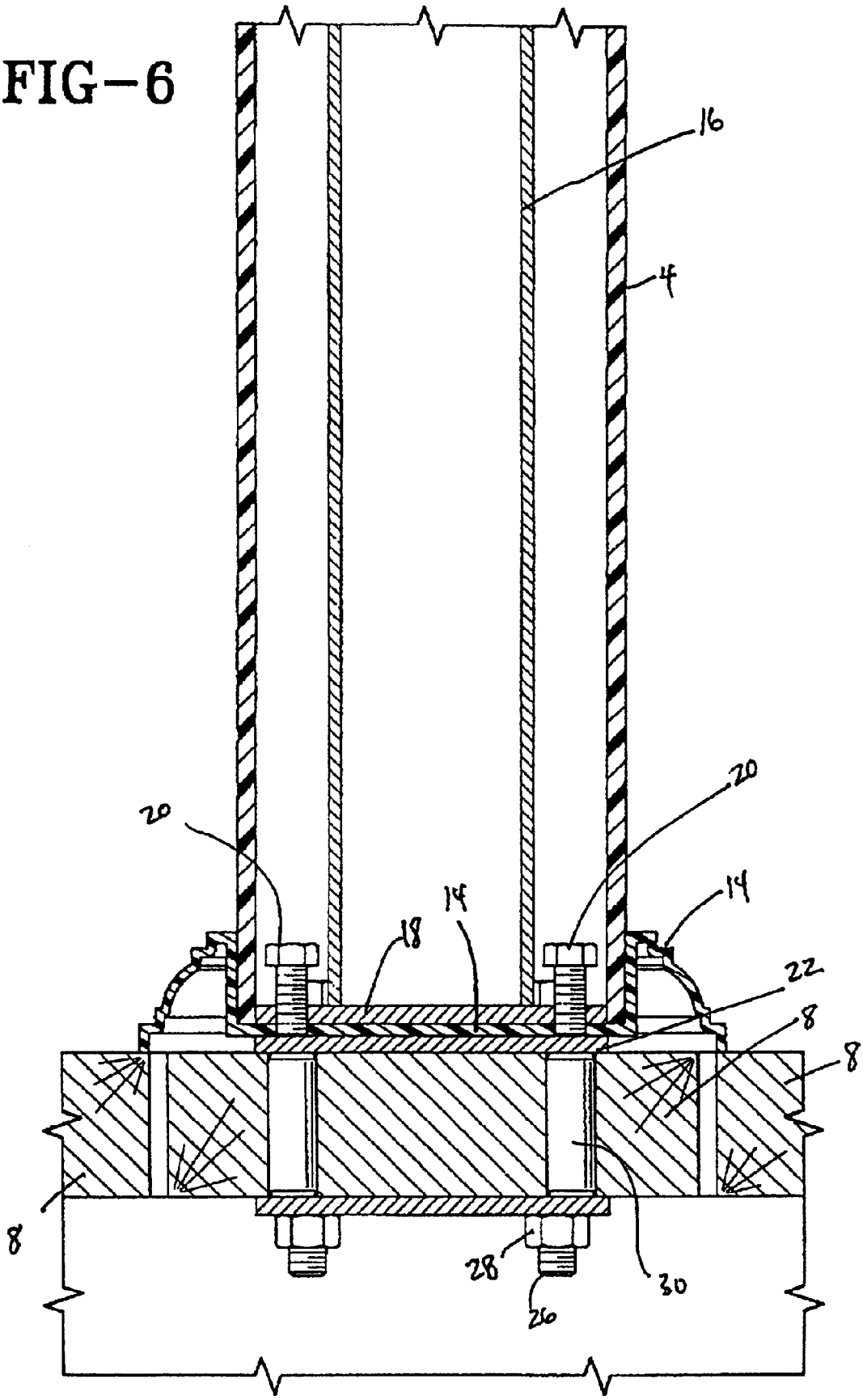
FIG. 6 is a longitudinal sectional view of the first embodiment as shown in FIG. 1 taken along line 6—6 of FIG. 3.

A second embodiment of the present invention is indicated generally by the numeral 102 in FIG. 5. Post mount 102 is substantially similar to post mount 2 except it is used in conjunction with a floor 106 that does not have an exposed underside, such as a concrete floor that is poured against the grade. Floor 106 is formed with a plurality of bolt holes 151, and a threaded insert 158 is installed in each bolt hole 151 in a manner known in the art that prevents insert 158 from being pulled out of hole 151. Threaded insert 158 contains a plurality of internal threads that cooperate threadably with external threads 56 formed on bolt 26. Adjustment bolts 20 are adjusted until support block 16 is oriented plumb with the vertical direction, and bolt 26 is threaded into threaded insert 158 to hold support block 16 in position.

Accordingly, the improved post mount apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the post mount is constructed and used, the characteristics of the construction, and the advantageous new and useful results obtained; the new and useful structures, devices, elements, arrangements, parts, and combinations are set forth in the appended claims.

I claim:

1. In combination:

a floor member;

a post mount having a first and a second end, said post mount being mounted to the floor member proximate the first end; and wherein the post mount includes a head at the second end thereof;

a construction member having a cavity in a first end, the cavity defining the inner surface of the construction member;

said post mount being slidably received in said cavity; the post mount having at least one inwardly deflectable tab that extends outwardly from the head, wherein the tab flexes as the post mount is slid into the cavity while thereafter frictionally engaging the inner surface of the construction member.

2. The combination as set forth in claim 1 wherein at least one outwardly extending, inwardly deflectable tab is a plurality of outwardly extending, inwardly deflectable tabs.

3. The combination as set forth in claim 2 wherein said post mount includes an elongated body extending from an adjustment plate attached at the first end of the post mount to the second end of the post mount, where the body is of a lesser cross sectional dimension than at least one of the adjustment plate and a perimeter defined by the plurality of outwardly extending, inwardly deflectable tabs.

4. In combination:

a floor member;

a post mount having a first and a second end, said post mount being mounted to the floor member proximate the first end; wherein the post mount includes an elongated body extending from an adjustment plate attached at the first end of the post mount to the second end of the post mount; wherein the post mount further includes a head including an end plate substantially perpendicular to the elongated body;

a construction member having a cavity in a first end, the cavity defining the inner surface of the construction member;

said post mount being slidably received in said cavity; and wherein the post mount has a plurality of outwardly extending, inwardly deflectable tabs that arcuately transition from the periphery of the end plate; the tabs flexing as the post mount is slid into the cavity while thereafter frictionally engaging the inner surface of the construction member; and wherein the elongated body is of a lesser cross sectional dimension than at least one of the adjustment plate and a perimeter defined by the plurality of outwardly extending, inwardly deflectable tabs.

5. The combination as set forth in claim 4, wherein said adjustment plate is interposed between said elongated body and said floor member.

6. The combination as set forth in claim 5, further comprising a plurality of securing bolts operatively attaching the said adjustment plate to the floor member.

7. The combination as set forth in claim 6, further comprising at least one adjustment bolt operatively attached to said adjustment plate, wherein adjustment of said adjustment plate via said adjustment bolt with respect to said floor causes a corresponding movement of said elongated body with respect to the vertical direction.

8. The combination as set forth in claim 7, further comprising a bearing plate interposed between said floor member and said adjustment plate.

9. The combination as set forth in claim 8, further comprising a clamping plate where said floor member is interposed between said clamping plate and said bearing plate.

10. The combination as set forth in claim 7, further comprising a clamping plate wherein said floor member is interposed between said clamping plate and said adjustment plate.

11. The combination as set forth in claim 10, further comprising at least a first compression pin interposed between said adjustment plate and said clamping plate.

12. In combination;

a floor member;

a post mount mounted on the floor member;

a construction member having a cavity in a first end, said post mount being slidably received in said cavity;

said post mount including at least a first deflection member formed on and extending outwardly from a head of said post mount for deflecting as the post mount is slid into the cavity while thereafter frictionally engaging the inner surface of the construction member.

13. A post mount for supporting a construction member on a surface, the construction member formed with a cavity in a first end, the post mount comprising:

a support block having a first and second end with a support surface therebetween, said support surface configured to be slidingly received in the cavity, and said support block further including an adjustment plate at a first end thereof and a head at a second end thereof and having at least one outwardly extending, inwardly deflectable tab extending from the head; which tab flexes as the post mount is slid into the cavity while thereafter frictionally engaging the inner surface of the construction member; and at least one securing bolt passing through at least a portion of said adjustment plate, each of said at least one bolt adapted to be engagable with the surface to connect said support block to the surface.

14. The post mount as set forth in claim 12, further comprising at least one adjustment bolt threadedly disposed within the at least one threaded hole in the adjustment plate; the adjustment bolt adapted to alter the position of the adjustment plate with respect to the surface by engaging the surface and moving at least a portion of the adjustment plate away from the surface.

15. The post mount as set forth in claim 14, further comprising a bearing plate, said adjustment plate interposed between said bearing plate and said support block.

16. The post mount as set forth in claim 15, wherein said bolt passes through each of said adjustment plate and said bearing plate.

17. The post mount as set forth in claim 16, further comprising a clamping plate and a nut, said bearing plate being interposed between said clamping plate and said adjustment plate.

18. The combination as set forth in claim 13, wherein at least one outwardly extending, inwardly deflectable tab is a plurality of outwardly extending, inwardly deflectable tabs.

19. A post mount for supporting a construction member on a surface, the construction member formed with a cavity in a first end, the post mount comprising:

a support block having a first and second end with a support surface therebetween, said support surface configured to be slidingly received in the cavity, and said support block further including an adjustment plate at a first end thereof and at least one outwardly extending, inwardly deflectable tab at the second end thereof that flexes as the post mount is slid into the cavity while thereafter frictionally engaging the inner surface of the construction member; and at least one securing bolt passing through at least a portion of said adjustment plate, each of said at least one bolt adapted to be engagable with the surface to connect said support block to the surface wherein the post mount includes a head including an end plate substantially perpendicular to the elongated body with the plurality of tabs arcuately transitioning from the periphery of the end plate.

20. In combination:

a floor member;

a post mount mounted on the floor member;

a construction member having a cavity in a first end, said post mount being slidably received in said cavity;

said post mount including a support block with an end plate mounted substantially perpendicularly to the block and at least a first deflection member formed on and arcuately transitioning from the periphery of the end plate of said post mount for deflecting as the post mount is slid into the cavity while thereafter frictionally engaging the inner surface of the construction member.

21. A post mount for supporting a construction member on a surface, the construction member formed with a cavity in a first end, the post mount comprising:

a support block having a first and second end with a support surface therebetween, said support surface configured to be slidingly received in the cavity, and said support block further including an adjustment plate at a first end thereof and an end plate at the second end thereof, the end plate lying substantially perpendicular to the support surface and having at least one outwardly extending, inwardly deflectable tab arcuately transitioning therefrom; which tab flexes as the post mount is slid into the cavity while thereafter frictionally engaging the inner surface of the construction member; and at least one securing bolt passing through at least a portion of said adjustment plate, each of said at least one bolt adapted to be engagable with the surface to connect said support block to the surface.

* * * * *